US005396914A

United States Patent [19]

McNair

[11] Patent Number: 5,396,914

[45] Date of Patent: Mar. 14, 1995

[54] DETERGENT DISPENSER IN A DISHWASHING MACHINE

[75] Inventor: John D. McNair, Monbulk, Australia

[73] Assignee: Vulcan Australia Limited, Bayswater, Australia

[21] Appl. No.: 858,990

[22] PCT Filed: Nov. 23, 1990

[86] PCT No.: PCT/AU90/00561

§ 371 Date: Jun. 29, 1992

§ 102(e) Date: Jun. 29, 1992

[87] PCT Pub. No.: WO91/07905

PCT Pub. Date: Jun. 13, 1991

[30] Foreign Application Priority Data

Nov. 23, 1989 [AU] Australia ..... PJ7530

[51] Int. Cl.[6] ..... B08B 3/02

[52] U.S. Cl. ..... 134/57 D; 134/93; 134/94.1; 68/17 R; 68/207; 222/207; 137/564.5; 137/205.5

[58] Field of Search ..... 134/57 D, 56 D, 58 D, 134/93, 94.1; 239/310, 336, 303, 340, 398; 68/17 R, 207; 222/395, 389, 129.2, 133, 207, 200; 137/268, 565, 205.5, 564.5

[56] References Cited

U.S. PATENT DOCUMENTS 2,266,205 12/1941 Hunter .
2,592,885 4/1952 Fox et al. .
2,592,886 4/1952 Fox et al. .
2,843,137 7/1958 Federighi et al. ..... 134/57 D
3,021,863 2/1962 Low ..... 134/57 D
3,038,639 6/1962 Anderson ..... 68/207
3,085,416 4/1963 D'Nodge ..... 68/207
3,125,249 3/1969 Kendt .
4,407,127 8/1984 Platt et al. ..... 68/17 R
5,004,158 4/1991 Halem et al. ..... 137/564.1

*Primary Examiner*—Frankie L. Stinson
*Attorney, Agent, or Firm*—Ladas & Parry

[57] ABSTRACT

A dispenser device (10) for dispensing liquid detergent concentrate or cleaning agent into a washing zone of a washing appliance during a phase of a washing cycle. The washing appliance has a water pump (6) to provide the normal functions associated with washing cycles. Water pressure from the pump is utilised to squeeze or eject a predetermined quantity of concentrate from a container (28) into the washing zone at a desired phase of the washing process. In one adaptation, a container for the concentrate is in the form of a flexible bag (28) including an outlet nozzle (32) sealed until first placed in a receptacle (11) for use. In use, the nozzle (32) protrudes through an opening in a closure (12) of the receptacle into the washing zone. Via a second opening in the receptacle a small volume of water under pressure from the pump is directed under the timed control of a valve (26) at the required phase of the washing cycle into the closed receptacle. The receptacle may be compartmented with an inter-communicating orifice (20) separating one compartment (16) from another (18) whereby the bag in compartment (16), is subject to contact by hot water from the pump for a minimal time only.

19 Claims, 7 Drawing Sheets

DETERGENT DISPENSER IN A DISHWASHING MACHINE

BACKGROUND

The present invention relates to apparatus for dispensing liquids. It is particularly applicable for example in admitting of detergent into dishwashers.

In some appliances such as domestic dishwashing machines, it is usual for the user to place the detergent in granulated form in a mechanical dispenser which is mounted on the door of the dishwasher. The detergent is a highly reactive substance and there exists a need for improving the dispensing of the detergent into the machine. In particular it is desirable that a bulk dispenser can be used which will minimize the exposure of the user to the detergent. The dispenser should also dispense the correct quantity of detergent into the machine when required. Dishwashing detergent can be made in liquid form but it tends to be subject to separation or breaking down when exposed to air or excessive temperatures.

The object of the present invention is to provide a dispensing apparatus which can simply and effectively dispense liquid agents in an appliance.

It is also an object to provide a novel container for detergent.

SUMMARY

According to the present invention there is provided apparatus for dispensing a first liquid in an appliance which includes a pump for pumping a second liquid therein, said apparatus including first means for receiving a container of said first liquid, said container including an outlet, said first means being such that at least part of the container is subjected to the second liquid under pressure from said pump, second means for establishing a fluid communication path from the container outlet to a dispensing point or zone and control means operative to open and close said path to thereby control the time for which the container is, in use, subjected to the pressure of said second liquid and therefore to control the volume of said first liquid expelled through the outlet.

In one arrangement, the container comprises a collapsible bag containing said first liquid, the external surface of the bag is subjected, in use, to the pressure of said second liquid.

In another form the container includes a cylinder and piston slidably movable therein, the piston being subjected, in use, to the pressure of the second liquid.

When the appliance comprises a dishwasher or clothes washer the first liquid comprises detergent and the second liquid comprises water.

The invention also provides a container for dishwashing detergent, said container comprising a flexible bag and an outlet nozzle.

The invention also provides a container for dishwashing detergent, said container comprising a cylinder and piston slidably movable therein, and an outlet in the cylinder for discharging detergent when the piston moves under pressure of a fluid applied thereto.

DESCRIPTION OF THE DRAWINGS

The invention will now be further described with reference to the accompanying drawings in which:

FIG. 1 schematically illustrates a dishwasher having a bowl 4 and pump 6 which supplies water under pressure to a rotating spray arm 8, in the usual way. The dishwasher includes a dispensing apparatus 10 in accordance with the invention. The dispensing apparatus is arranged to dispense at appropriate times liquid detergent concentrate into the bowl 4 of the dishwasher.

FIG. 3 illustrates in more detail the dispenser 10 of the invention, it comprises a hollow cylindrical body 11 which is provided with means (not shown) for being mounted in the bowl 4 of the dishwasher in a leak proof manner. The upper end of the body 11 is threaded so as to receive a cap 12. The body 11 includes upper and lower chambers 16 and 18 which are connected together by means of a short duct 20. The bottom of the body 11 is formed with a spigot 22 for receipt of a condult 24 which extends to the outlet of the main pump 6. A control valve 28 is connected in the conduit 24, as shown in FIG. 1. A container 28 of liquid detergent is placed in the upper chamber 16 for dispensing at appropriate times into the bowl 4 of the dishwasher. The container 28 comprises a flexible bag 30 having an outlet nozzle 32 coupled thereto. The outlet nozzle 32 passes through an opening in the centre of the cap 12. The nozzle 32 is preferably formed of resilient material so as to seal against the cap. The nozzle 32 is normally closed so that when the user handles it, there is little possibility that the liquid detergent will come into contact with the user. When it is desired to place the container 28 in the dispenser, the cap 12 is removed and the nozzle 32 is placed through the opening in the cap. The container 28 is then placed in the chamber 16 and the cap 12 screwed down. The nozzle can then be opened say by removing its end 34 as schematically illustrated in FIG. 4. This would be appropriate where the container 28 is disposable. For a refillable arrangement, a screw cap or the like may be provided.

Figure 1:
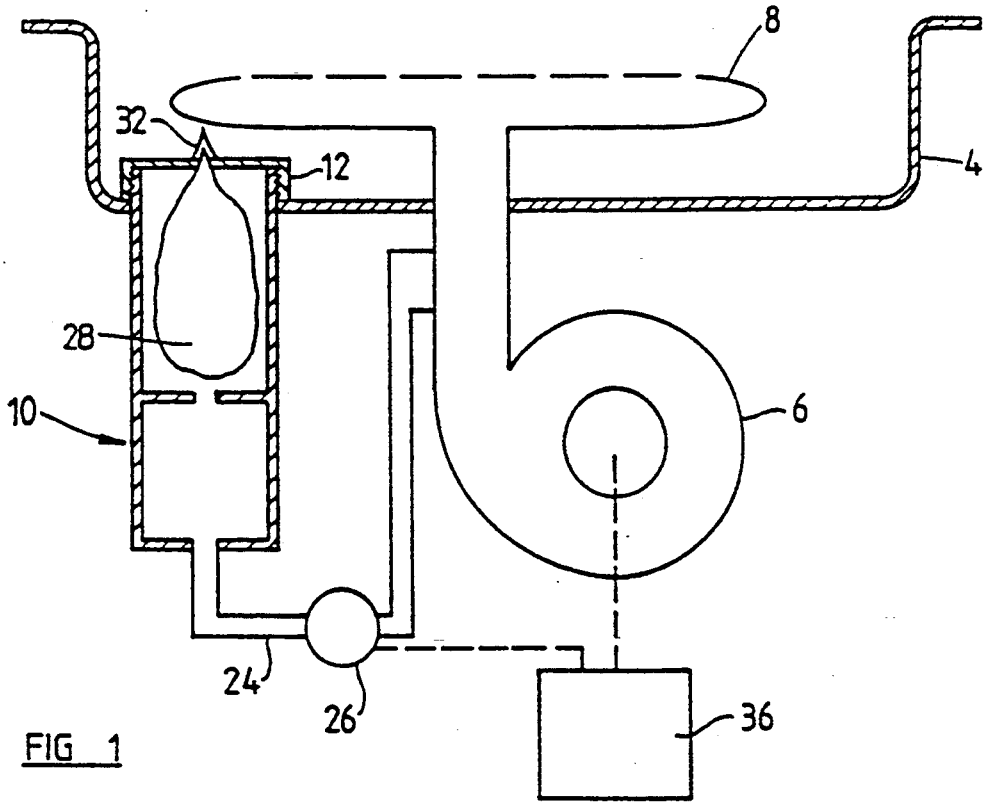
FIG. 1 is a schematic view of part of a dishwashing apparatus incorporating a dispenser of the invention.

When the pump 6 of the dishwasher operates, it will have a pressure of about 2–5 psi (15–35 kPa) at its outlet. The pressurised water is selectively coupled to the lower chamber 18 of the dispenser under the control of the valve 26. The valve 26 would simply comprise a solenoid valve which is controlled by the timer 36 of the dishwasher. When the valve 26 is open, the pressure of the water in the chambers 16 and 18 causes collapsing of the bag 30 and hence discharge of the detergent into the bowl of the dishwasher. The volume of detergent dispensed will depend upon a number of parameters including the time for which the valve 26 is open and the rate upon which the detergent can escape from the nozzle 32. These parameters, particularly the opening of the valve 26, can be controlled to give the correct volume.

It will be appreciated that in accordance with the invention there is provided a very simple yet effective dispenser for dispensing the liquid detergent. The valve 26 has the dishwasher water passing through it and is not subjected to the corrosive action of the concentrated detergent. The lower chamber 18 is provided so as to tend to minimise the contact of the container 28 with hot water from the pump 6. When the dishwasher is not in use, the chambers 16 and 18 will be full of cold water. When the valve 26 is opened hot water from the pump will be introduced into the lower chamber 18 near the bottom thereof so that the hot water entering the chamber 18 will be diluted so as to reduce the temperature of the water which comes into contact with the container. This prolongs the life of the detergent in the container.

Figure 8:
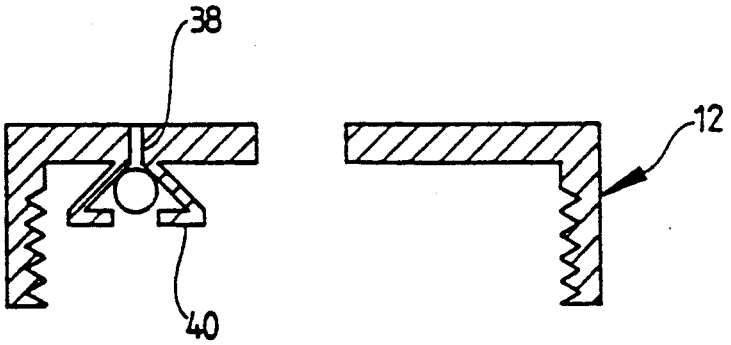
FIG. 8 shows a further modification of the invention.

When a new container 28 is placed in the dispenser some air may be present in the upper chamber 16. The presence of this air could cause an excess of detergent to be dispensed because the air would pressurise when the valve 26 is open and would slowly reduce the pressure even when the valve is closed by forcing the detergent through the orifice 32. To avoid the possibility of this excess discharge of detergent occurring, an air duct 38 can be provided conveniently in the cap 12 to enable escape of air more quickly. Any water leaking through into the duct 38 into the bowl would be immaterial. Indeed, the duct 38 could ensure that over a period of time the water in the chambers 16 and 18 is changed so as to avoid build-up of stagnant water therein. An alternative arrangement is illustrated in FIG. 8 where the cap includes a ball valve 40 which enables escape of air through the duct 38 but prevents water passing there through. The ball valve includes a buoyant ball which closes the valve when water touches it.

Figure 2:
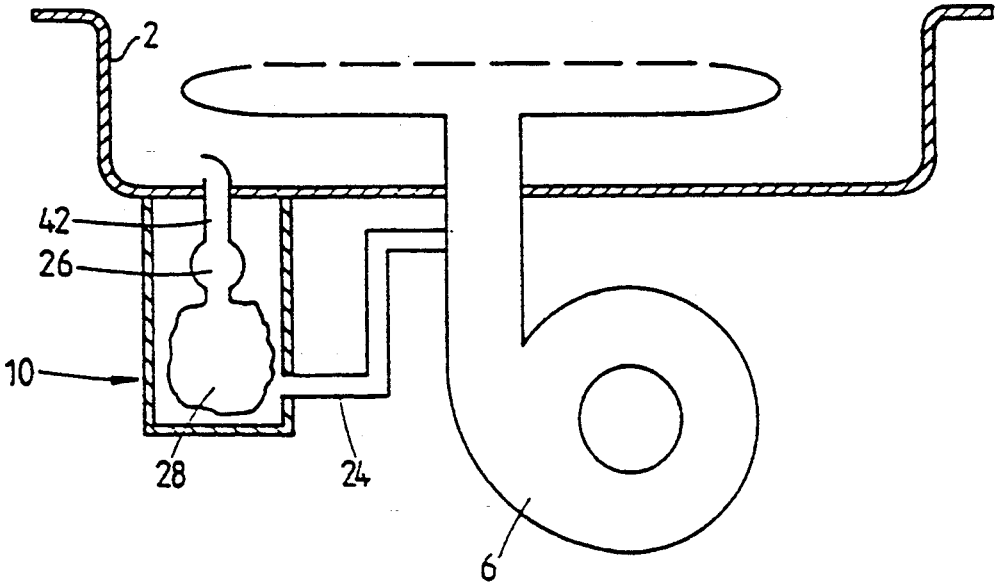
FIG. 2 is a schematic view of a modified arrangement.

FIG. 2 illustrates a modified arrangement and the same reference numerals have been used for corresponding parts. In this arrangement, the valve 26 is located in a duct 42 which extends from the container 28 to the bowl 2 of the dishwasher. The operation is otherwise the same.

In a modified arrangement the dispenser 10 could be integrally formed with the bowl of the dishwasher or be located in the door of the dishwasher.

Figure 5:
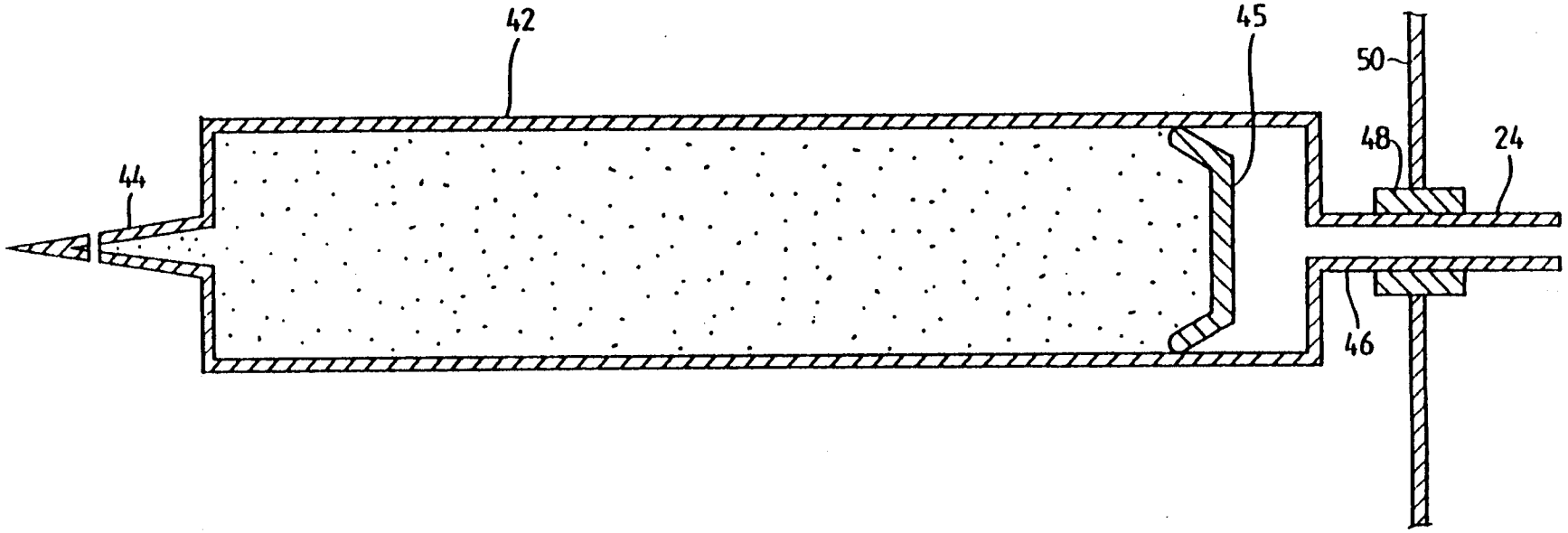
FIG. 5 shows a modified dispenser of the invention.

FIG. 5 diagrammatically illustrates a further modification. In this arrangement, the detergent or chemical container 42 comprises a cylindrical body of relatively rigid plastics material having a nozzle 44 at one end. A piston 46 is located at the other end of the cylindrical body. The arrangement is somewhat analogous to the cartridges used for sealants or adhesives which are used in conjunction with plunger guns. At the end of the body opposite to the nozzle 44 is a spiggot 46 which can be sealingly engaged with a socket 48 in the wall 50 of a dishwasher or other appliance. The socket 48 communicates with the condult 24 in a similar way to that shown in FIG. 1. When the valve 26 opens, the water under pressure will be subjected to the end of the piston 45 and cause it to move towards the nozzle 44 and thereby discharge the detergent through the nozzle. The quantity of detergent discharge depends upon a number of parameters as before but generally speaking can be controlled by setting the duration of opening of the valve 26.

Figure 6:
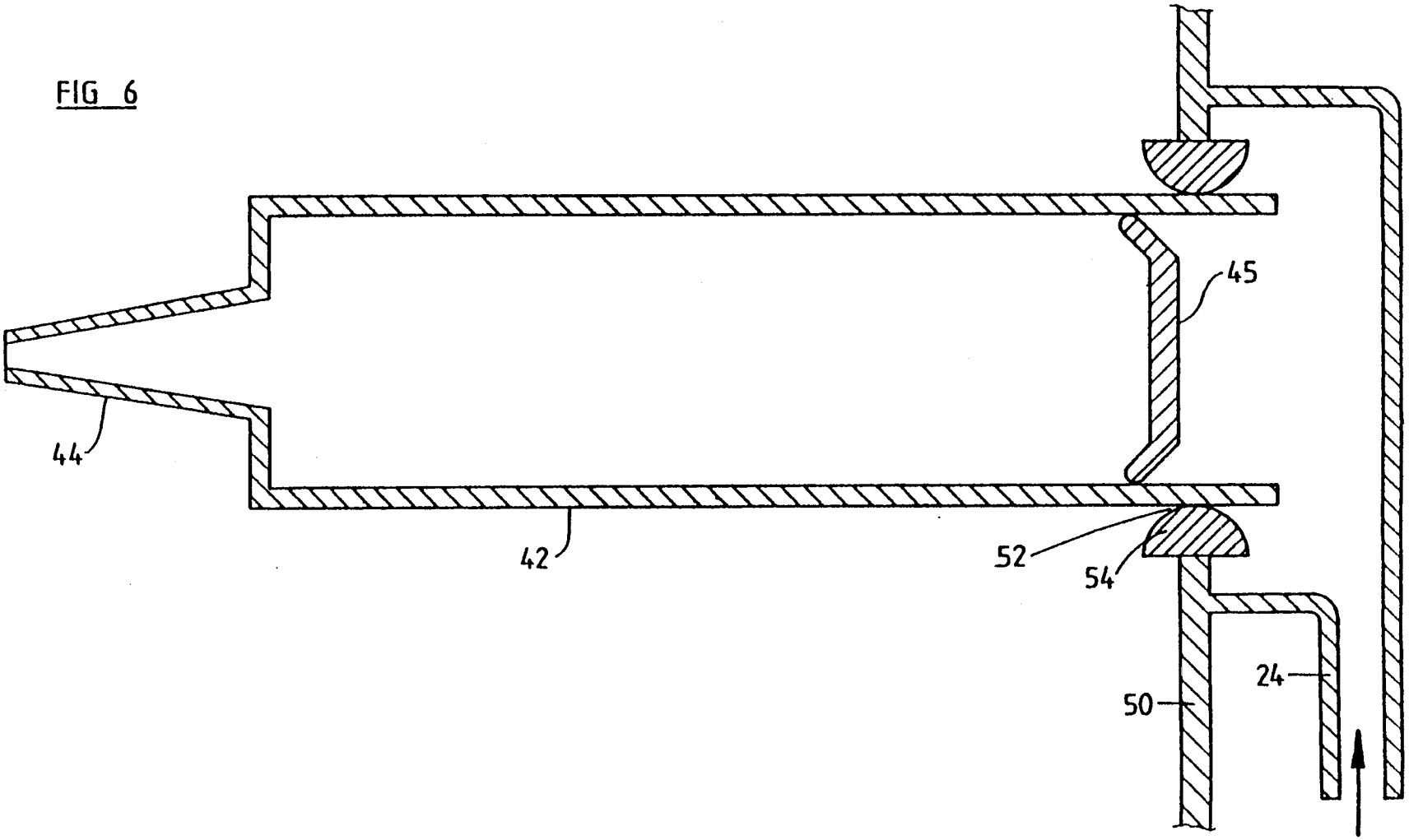
FIG. 6 is a further modified dispenser of the invention.

FIG. 6 illustrates an alternative arrangement in which the sidewall 50 includes an opening 52 which is large enough to receive the end of the cylindrical body 42. A sealing gromet 54 is mounted in the opening 52 so as to sealingly engage the surface of the body 42. Again the pressure of fluid in the conduit 24 acts upon the piston 45 so as to discharge the detergent through the nozzle 46 into the dishwasher.

Figure 3:
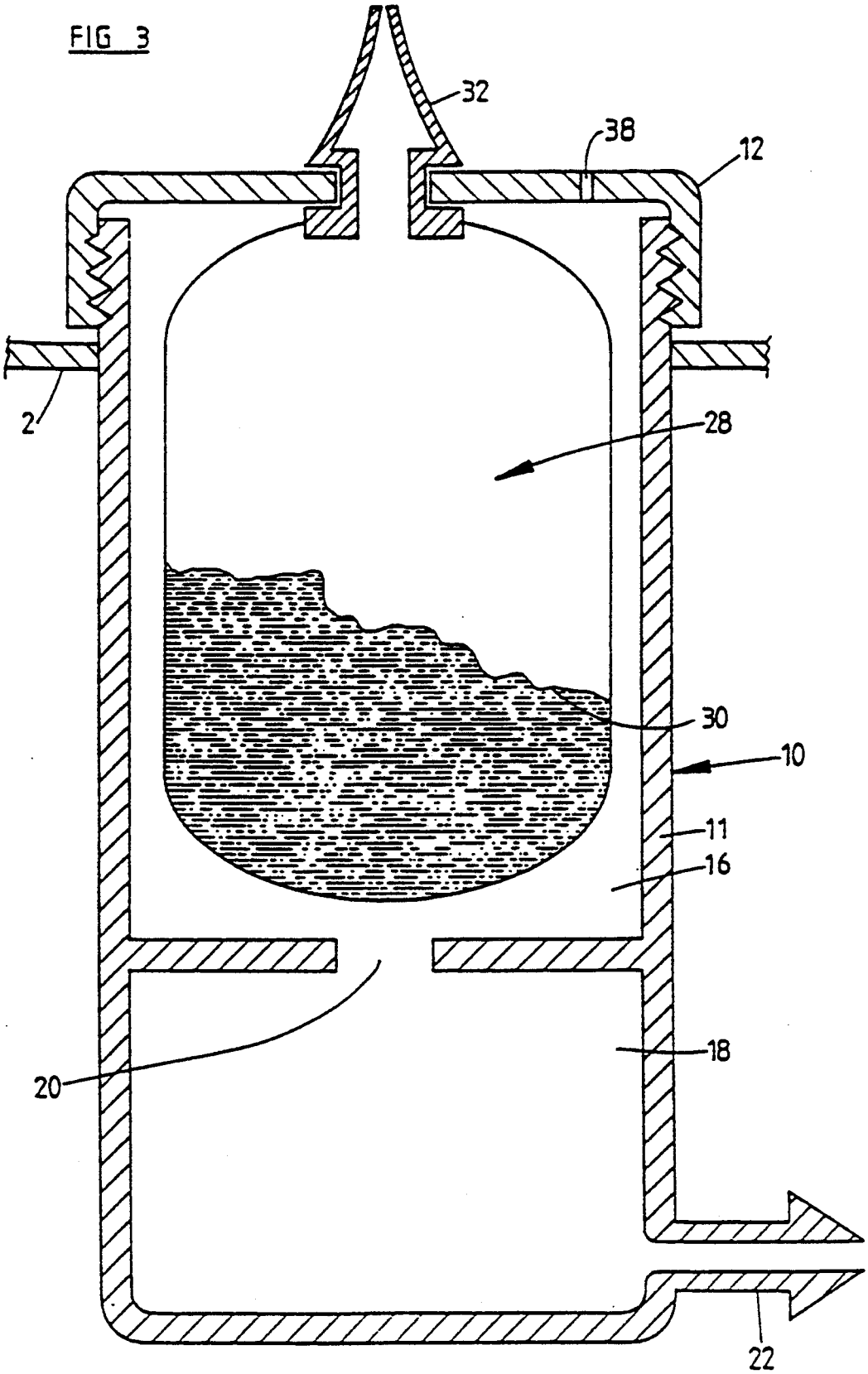
FIG. 3 is a more detailed schematic view of the dispenser.
Figure 4:
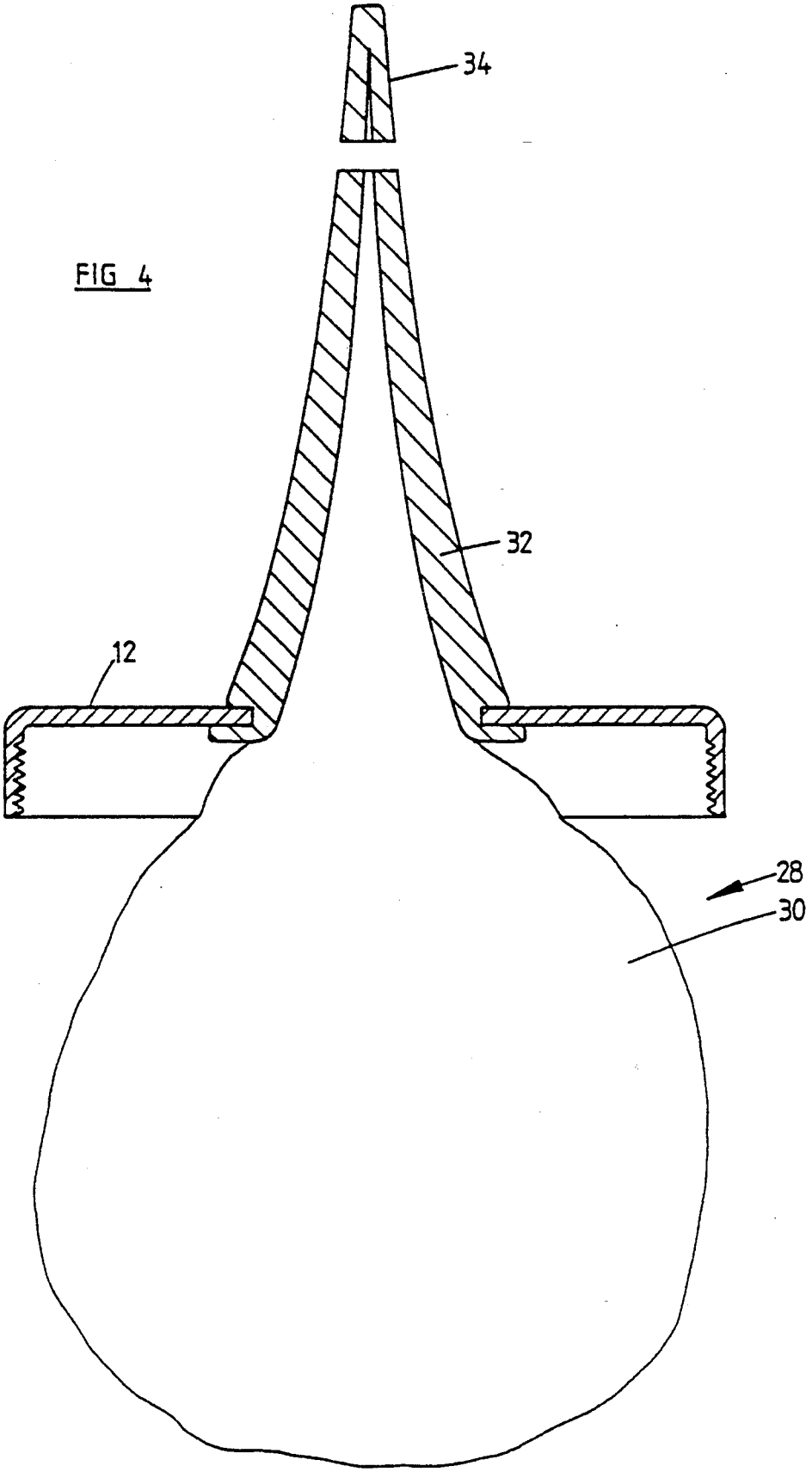
FIG. 4 is a schematic view of a container.
Figure 7:
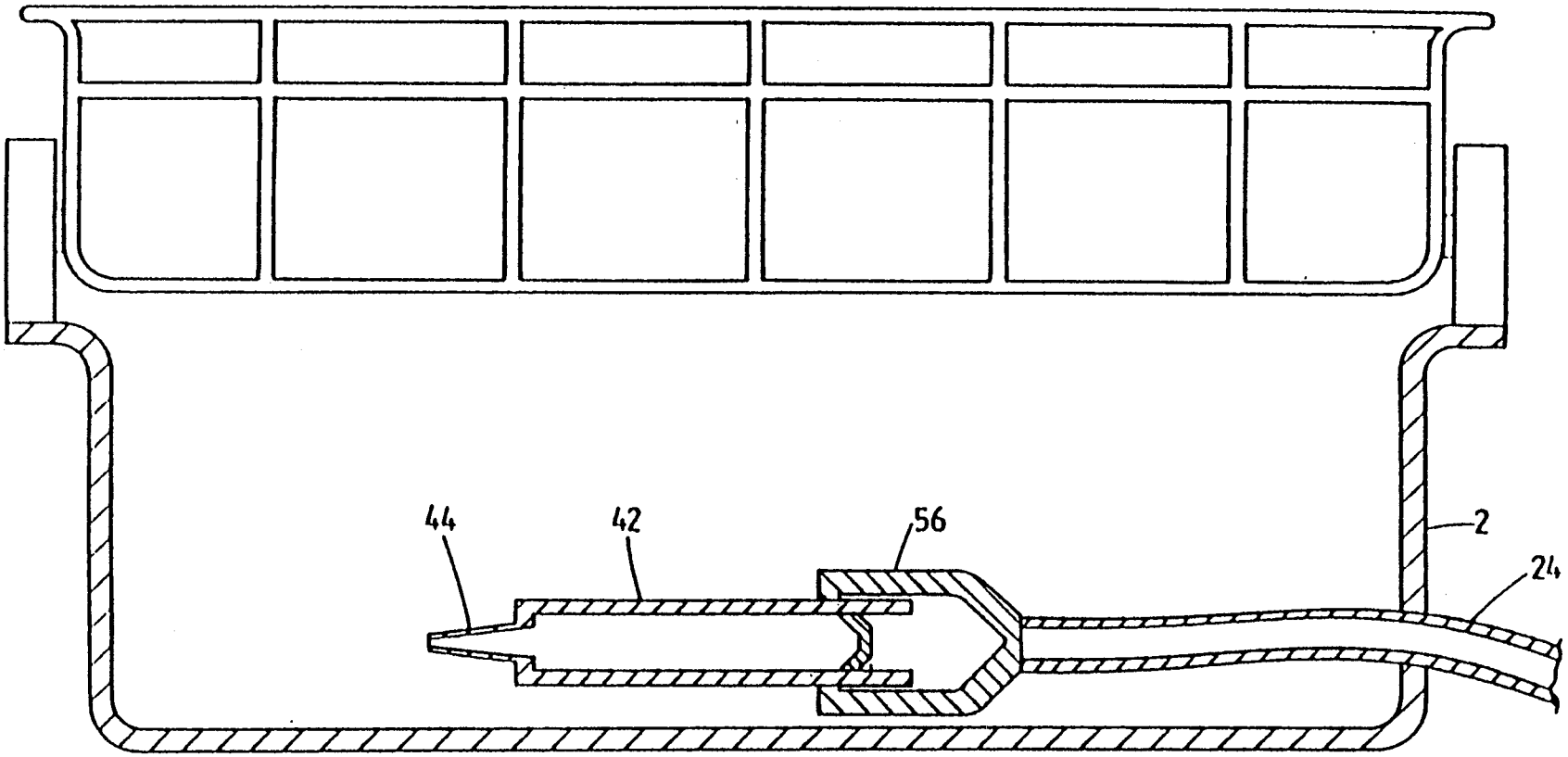
FIG. 7 is a schematic view of a still further modified arrangement of the invention.

FIG. 7 illustrates a further modified arrangement. In this arrangement the conduit 24 extends into the bowl 2 of the dishwasher. The conduit 24 is connected to a relatively large socket 56 which seals against the cylindrical body 42 of the container. Again the pressure in the conduit 24 controls discharge of detergent from the nozzle 44. It will be appreciated that the arrangements of FIGS. 5, 6 and 7 permit easy changing of the containers when empty. It is preferred that they be made of transparent material so that the user can determine by visual inspection when the containers are empty. Similarly, in the arrangements of FIGS. 1, 3 and 4 it is preferred that the cap 12 and/or nozzle 32 is made from transparent material which would enable the user to determine if there is any detergent in the bag 30. It is also preferred that the detergent be coloured so as to assist in this inspection.

Many modifications will be apparent to those skilled in the art without departing from the spirit and scope of the invention.

I claim:

1. Apparatus for dispensing a first liquid in an appliance which includes a pump for pumping a second liquid therein, said apparatus including first means for receiving a container of said first said liquid, said container including an outlet, said first means being such that at least part of the container is subjected to the second liquid under pressure from said pump, second means for establishing a fluid communication path from the container outlet to a dispensing point or zone and control means operative to open and close said path to thereby control the time for which the container is, in use, subjected to the pressure of said second liquid and therefore to control the volume of said first liquid expelled through the outlet;

wherein said first means includes a first chamber within which the container is, in use, located;

wherein the first means includes a second chamber located beneath the first chamber, the first and second chambers being in fluid communication for said second liquid;

wherein the appliance comprises a dishwasher having a bowl and the first means comprises a cylindrical body and means for mounting the body in the bowl;

wherein the body includes a removable cap which is accessible from the interior of the appliance and wherein said second means includes an opening in said cap;

wherein the container includes a wall which is collapsible under pressure of said second liquid;

wherein the container includes a flexible bag; and wherein the container includes a nozzle for delivery of the first fluid to dispensing point or zone and wherein said nozzle registers, in use, with said opening in the cap.

2. Apparatus as claimed in claim 1 wherein the control means includes a valve and a timing means the timing means being coupled to control the operation of the valve.

3. Apparatus as claimed in claim 2 wherein the valve is located between the pump and said first means.

4. Apparatus as claimed in claim 3, wherein the container includes a cylindrical chamber and piston slidably mounted therein, said second liquid being operable to displace the piston so as to discharge the first liquid at the dispensing point or zone.

5. Apparatus as claimed in claim 4, wherein the container comprises a disposable cylindrical body and the first means includes a fluid conduit for said second liquid and sealing means for forming a coupling between the cylindrical body and said fluid conduit.

6. Apparatus as claimed in claim 3, wherein the container is at least partially transparent.

7. Apparatus as claimed in claim 2, wherein the container includes a cylindrical chamber and piston slidably mounted therein, said second liquid being operable to displace the piston so as to discharge the first liquid at the dispensing point or zone.

8. Apparatus as claimed in claim 7, wherein the container comprises a disposable cylindrical body and the first means includes a fluid conduit for said second liquid and sealing means for forming a coupling between the cylindrical body and said fluid conduit.

9. Apparatus as claimed in claim 2, wherein the container is at least partially transparent.

10. Apparatus as claimed in claim 1 wherein the flexible bag is located in the first chamber.

11. Apparatus as claimed in claim 10, wherein the container is at least partially transparent.

12. Apparatus as claimed in claim 1, including an air discharge opening extending from the first chamber to inside the bowl.

13. Apparatus as claimed in claim 1, wherein the container includes a cylindrical chamber and piston slidably mounted therein, said second liquid being operable to displace the piston so as to discharge the first liquid at the dispensing point or zone.

14. Apparatus as claimed in claim 13 wherein the container comprises a disposable cylindrical body and the first means includes a fluid conduit for said second liquid and sealing means for forming a coupling between the cylindrical body and said fluid conduit.

15. Apparatus as claimed in claim 14 wherein the appliance comprises a dishwasher having a bowl and the conduit permits the cylindrical body to be placed in the dishwasher.

16. Apparatus as claimed in claim 13 wherein the appliance comprises a dishwasher having a door and including means for mounting the container in the door.

17. Apparatus as claimed in claim 1 wherein the first liquid comprises concentrated detergent or cleaning agent.

18. Apparatus as claimed in claim 1 wherein the container is at least partially transparent.

19. Apparatus as claimed in claim 18 wherein the first liquid is coloured.

* * * * *